US007843410B2

(12) United States Patent
Floyd

(10) Patent No.: US 7,843,410 B2
(45) Date of Patent: Nov. 30, 2010

(54) METHOD AND DEVICE FOR ELECTRICALLY PROGRAMMABLE DISPLAY

(75) Inventor: Philip D. Floyd, Redwood City, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 1508 days.

(21) Appl. No.: 11/134,007

(22) Filed: May 20, 2005

(65) Prior Publication Data

US 2006/0066598 A1 Mar. 30, 2006

Related U.S. Application Data

(60) Provisional application No. 60/613,379, filed on Sep. 27, 2004.

(51) Int. Cl.
*G09G 3/34* (2006.01)

(52) U.S. Cl. ..... 345/85; 345/108; 345/204; 345/690; 345/694; 345/698; 359/290; 359/292; 359/577; 359/578

(58) Field of Classification Search ..... 345/77, 345/87, 89, 204, 690, 84, 85, 104, 108, 694–698; 359/290–292, 522, 528, 578, 577, 224, 247, 359/584, 586, 589

See application file for complete search history.

(56) References Cited

U.S. PATENT DOCUMENTS

| | | | |
|---|---|---|---|
| 3,982,239 | A | 9/1976 | Sherr |
| 4,403,248 | A | 9/1983 | te Velde |
| 4,441,791 | A | 4/1984 | Hornbeck |
| 4,459,182 | A | 7/1984 | te Velde |
| 4,482,213 | A | 11/1984 | Piliavin et al. |
| 4,500,171 | A | 2/1985 | Penz et al. |
| 4,519,676 | A | 5/1985 | te Velde |
| 4,566,935 | A | 1/1986 | Hornbeck |
| 4,571,603 | A | 2/1986 | Hornbeck et al. |
| 4,596,992 | A | 6/1986 | Hornbeck |

(Continued)

FOREIGN PATENT DOCUMENTS

| | | | |
|---|---|---|---|
| EP | 0295802 | A | 12/1988 |

(Continued)

OTHER PUBLICATIONS

Seeger et al., "Stabilization of Electrostatically Actuated Mechanical Devices", (1997) International Conference on Solid State Sensors and Actuators; vol. 2, pp. 1133-1136.

(Continued)

*Primary Examiner*—Lun-Yi Lao
*Assistant Examiner*—Jennifer T Nguyen
(74) *Attorney, Agent, or Firm*—Knobbe Martens Olson & Bear LLP

(57) ABSTRACT

One embodiment includes a display of interferometric modulators having a configurable resolution characteristic. Selected rows and/or columns are interconnected via a switch. The switch can include a fuse, antifuse, transistor, and the like. Depending on a desired resolution for a display, the switches can be placed in an "open" or "closed" state. Advantageously, using the switches, a display can readily be configured for differing modes of resolution. Furthermore, using the switches, a display can be configured to electrically connect certain rows or columns in the display such that the connected rows or columns can be driven simultaneously by a common voltage source.

17 Claims, 10 Drawing Sheets

U.S. PATENT DOCUMENTS

| | | | | |
|---|---|---|---|---|
| 4,615,595 | A | | 10/1986 | Hornbeck |
| 4,662,746 | A | | 5/1987 | Hornbeck |
| 4,681,403 | A | | 7/1987 | te Velde et al. |
| 4,709,995 | A | | 12/1987 | Kuribayashi et al. |
| 4,710,732 | A | | 12/1987 | Hornbeck |
| 4,856,863 | A | | 8/1989 | Sampsell et al. |
| 4,859,060 | A | | 8/1989 | Katagiri et al. |
| 4,954,789 | A | | 9/1990 | Sampsell |
| 4,956,619 | A | | 9/1990 | Hornbeck |
| 4,982,184 | A | | 1/1991 | Kirkwood |
| 5,018,256 | A | | 5/1991 | Hornbeck |
| 5,028,939 | A | | 7/1991 | Hornbeck et al. |
| 5,037,173 | A | | 8/1991 | Sampsell et al. |
| 5,055,833 | A | | 10/1991 | Hehlen et al. |
| 5,061,049 | A | | 10/1991 | Hornbeck |
| 5,078,479 | A | | 1/1992 | Vuilleumier |
| 5,079,544 | A | | 1/1992 | DeMond et al. |
| 5,083,857 | A | | 1/1992 | Hornbeck |
| 5,096,279 | A | | 3/1992 | Hornbeck et al. |
| 5,099,353 | A | | 3/1992 | Hornbeck |
| 5,124,834 | A | | 6/1992 | Cusano et al. |
| 5,142,405 | A | | 8/1992 | Hornbeck |
| 5,142,414 | A | | 8/1992 | Koehler et al. |
| 5,162,787 | A | | 11/1992 | Thompson et al. |
| 5,168,406 | A | | 12/1992 | Nelson |
| 5,170,156 | A | | 12/1992 | DeMond et al. |
| 5,172,262 | A | | 12/1992 | Hornbeck |
| 5,179,274 | A | | 1/1993 | Sampsell |
| 5,192,395 | A | | 3/1993 | Boysel et al. |
| 5,192,946 | A | | 3/1993 | Thompson et al. |
| 5,206,629 | A | | 4/1993 | DeMond et al. |
| 5,212,582 | A | | 5/1993 | Nelson |
| 5,214,419 | A | | 5/1993 | DeMond et al. |
| 5,214,420 | A | | 5/1993 | Thompson et al. |
| 5,216,537 | A | | 6/1993 | Hornbeck |
| 5,226,099 | A | | 7/1993 | Mignardi et al. |
| 5,227,900 | A | | 7/1993 | Inaba et al. |
| 5,231,532 | A | | 7/1993 | Magel et al. |
| 5,233,385 | A | | 8/1993 | Sampsell |
| 5,233,456 | A | | 8/1993 | Nelson |
| 5,233,459 | A | | 8/1993 | Bozler et al. |
| 5,254,980 | A | | 10/1993 | Hendrix et al. |
| 5,272,473 | A | | 12/1993 | Thompson et al. |
| 5,278,652 | A | | 1/1994 | Urbanus et al. |
| 5,280,277 | A | | 1/1994 | Hornbeck |
| 5,287,096 | A | | 2/1994 | Thompson et al. |
| 5,287,215 | A | | 2/1994 | Warde et al. |
| 5,296,950 | A | | 3/1994 | Lin et al. |
| 5,305,640 | A | | 4/1994 | Boysel et al. |
| 5,312,513 | A | | 5/1994 | Florence et al. |
| 5,323,002 | A | | 6/1994 | Sampsell et al. |
| 5,325,116 | A | | 6/1994 | Sampsell |
| 5,327,286 | A | | 7/1994 | Sampsell et al. |
| 5,331,454 | A | | 7/1994 | Hornbeck |
| 5,339,116 | A | | 8/1994 | Urbanus et al. |
| 5,341,267 | A | * | 8/1994 | Whitten et al. ..... 361/56 |
| 5,365,283 | A | | 11/1994 | Doherty et al. |
| 5,411,769 | A | | 5/1995 | Hornbeck |
| 5,444,566 | A | | 8/1995 | Gale et al. |
| 5,446,479 | A | | 8/1995 | Thompson et al. |
| 5,448,314 | A | | 9/1995 | Heimbuch et al. |
| 5,452,024 | A | | 9/1995 | Sampsell |
| 5,454,906 | A | | 10/1995 | Baker et al. |
| 5,457,493 | A | | 10/1995 | Leddy et al. |
| 5,457,566 | A | | 10/1995 | Sampsell et al. |
| 5,459,602 | A | | 10/1995 | Sampsell |
| 5,461,411 | A | | 10/1995 | Florence et al. |
| 5,481,274 | A | | 1/1996 | Aratani et al. |
| 5,483,260 | A | | 1/1996 | Parks et al. |
| 5,488,505 | A | | 1/1996 | Engle |
| 5,489,952 | A | | 2/1996 | Gove et al. |
| 5,497,172 | A | | 3/1996 | Doherty et al. |
| 5,497,197 | A | | 3/1996 | Gove et al. |
| 5,499,062 | A | | 3/1996 | Urbanus |
| 5,506,597 | A | | 4/1996 | Thompson et al. |
| 5,515,076 | A | | 5/1996 | Thompson et al. |
| 5,517,347 | A | | 5/1996 | Sampsell |
| 5,523,803 | A | | 6/1996 | Urbanus et al. |
| 5,526,051 | A | | 6/1996 | Gove et al. |
| 5,526,172 | A | | 6/1996 | Kanack |
| 5,526,688 | A | | 6/1996 | Boysel et al. |
| 5,535,047 | A | | 7/1996 | Hornbeck |
| 5,548,301 | A | | 8/1996 | Kornher et al. |
| 5,551,293 | A | | 9/1996 | Boysel et al. |
| 5,552,924 | A | | 9/1996 | Tregilgas |
| 5,552,925 | A | | 9/1996 | Worley |
| 5,563,398 | A | | 10/1996 | Sampsell |
| 5,567,334 | A | | 10/1996 | Baker et al. |
| 5,570,135 | A | | 10/1996 | Gove et al. |
| 5,578,976 | A | | 11/1996 | Yao |
| 5,581,272 | A | | 12/1996 | Conner et al. |
| 5,583,688 | A | | 12/1996 | Hornbeck |
| 5,589,852 | A | | 12/1996 | Thompson et al. |
| 5,597,736 | A | | 1/1997 | Sampsell |
| 5,598,565 | A | | 1/1997 | Reinhardt |
| 5,600,383 | A | | 2/1997 | Hornbeck |
| 5,602,671 | A | | 2/1997 | Hornbeck |
| 5,606,441 | A | | 2/1997 | Florence et al. |
| 5,608,468 | A | | 3/1997 | Gove et al. |
| 5,610,438 | A | | 3/1997 | Wallace et al. |
| 5,610,624 | A | | 3/1997 | Bhuva |
| 5,610,625 | A | | 3/1997 | Sampsell |
| 5,612,713 | A | | 3/1997 | Bhuva et al. |
| 5,613,103 | A | | 3/1997 | Nobutani et al. |
| 5,619,061 | A | | 4/1997 | Goldsmith et al. |
| 5,619,365 | A | | 4/1997 | Rhoads et al. |
| 5,619,366 | A | | 4/1997 | Rhoads et al. |
| 5,629,790 | A | | 5/1997 | Neukermans et al. |
| 5,633,652 | A | | 5/1997 | Kanbe et al. |
| 5,636,052 | A | | 6/1997 | Arney et al. |
| 5,638,084 | A | | 6/1997 | Kalt |
| 5,638,946 | A | | 6/1997 | Zavracky |
| 5,646,768 | A | | 7/1997 | Kaeiyama |
| 5,650,834 | A | | 7/1997 | Nakagawa et al. |
| 5,650,881 | A | | 7/1997 | Hornbeck |
| 5,654,741 | A | | 8/1997 | Sampsell et al. |
| 5,657,099 | A | | 8/1997 | Doherty et al. |
| 5,659,374 | A | | 8/1997 | Gale, Jr. et al. |
| 5,665,997 | A | | 9/1997 | Weaver et al. |
| 5,745,193 | A | | 4/1998 | Urbanus et al. |
| 5,745,281 | A | | 4/1998 | Yi et al. |
| 5,754,160 | A | | 5/1998 | Shimizu et al. |
| 5,771,116 | A | | 6/1998 | Miller et al. |
| 5,784,189 | A | | 7/1998 | Bozler et al. |
| 5,784,212 | A | | 7/1998 | Hornbeck |
| 5,808,780 | A | | 9/1998 | McDonald |
| 5,818,095 | A | | 10/1998 | Sampsell |
| 5,835,255 | A | * | 11/1998 | Miles ..... 359/291 |
| 5,842,088 | A | | 11/1998 | Thompson |
| 5,867,302 | A | | 2/1999 | Fleming et al. |
| 5,912,758 | A | | 6/1999 | Knipe et al. |
| 5,943,158 | A | | 8/1999 | Ford et al. |
| 5,959,763 | A | | 9/1999 | Bozler et al. |
| 5,966,235 | A | | 10/1999 | Walker et al. |
| 5,986,796 | A | | 11/1999 | Miles |
| 6,020,873 | A | | 2/2000 | Hori |
| 6,028,690 | A | | 2/2000 | Carter et al. |
| 6,038,056 | A | | 3/2000 | Florence et al. |
| 6,040,937 | A | | 3/2000 | Miles |
| 6,049,317 | A | | 4/2000 | Thompson et al. |
| 6,055,090 | A | | 4/2000 | Miles |
| 6,061,075 | A | | 5/2000 | Nelson et al. |
| 6,099,132 | A | | 8/2000 | Kaeriyama |
| 6,100,872 | A | | 8/2000 | Aratani et al. |

6,113,239 A 9/2000 Sampsell et al.
6,147,790 A 11/2000 Meier et al.
6,160,833 A 12/2000 Floyd et al.
6,180,428 B1 1/2001 Peeters et al.
6,201,633 B1 3/2001 Peeters et al.
6,232,936 B1 5/2001 Gove et al.
6,246,398 B1 6/2001 Koo
6,275,326 B1 8/2001 Bhalla et al.
6,282,010 B1 8/2001 Sulzbach et al.
6,295,154 B1 9/2001 Laor et al.
6,304,297 B1 10/2001 Swan
6,323,982 B1 11/2001 Hornbeck
6,327,071 B1 12/2001 Kimura
6,356,085 B1 3/2002 Ryat et al.
6,356,254 B1 3/2002 Kimura
6,429,601 B1 8/2002 Friend et al.
6,433,917 B1 8/2002 Mei et al.
6,446,486 B1 9/2002 DeBoer et al.
6,447,126 B1 9/2002 Hornbeck
6,465,355 B1 10/2002 Horsley
6,466,358 B2 10/2002 Tew
6,473,274 B1 10/2002 Maimone et al.
6,480,177 B2 11/2002 Doherty et al.
6,496,122 B2 12/2002 Sampsell
6,501,107 B1 12/2002 Sinclair et al.
6,507,330 B1 1/2003 Handschy et al.
6,507,331 B1 1/2003 Schlangen et al.
6,545,335 B1 4/2003 Chua et al.
6,548,908 B2 4/2003 Chua et al.
6,549,338 B1 4/2003 Wolverton et al.
6,552,840 B2 4/2003 Knipe
6,574,033 B1 6/2003 Chui et al.
6,589,625 B1 7/2003 Kothari et al.
6,593,934 B1 7/2003 Liaw et al.
6,600,201 B2 7/2003 Hartwell et al.
6,606,175 B1 8/2003 Sampsell et al.
6,625,047 B2 9/2003 Coleman, Jr.
6,630,786 B2 10/2003 Cummings et al.
6,632,698 B2 10/2003 Ives
6,643,069 B2 11/2003 Dewald
6,650,455 B2 11/2003 Miles
6,666,561 B1 12/2003 Blakley
6,674,090 B1 1/2004 Chua et al.
6,674,562 B1 1/2004 Miles
6,680,792 B2 * 1/2004 Miles ..... 359/291
6,710,908 B2 3/2004 Miles et al.
6,741,377 B2 5/2004 Miles
6,741,384 B1 5/2004 Martin et al.
6,741,503 B1 5/2004 Farris et al.
6,747,785 B2 6/2004 Chen et al.
6,750,876 B1 6/2004 Atsatt et al.
6,762,873 B1 7/2004 Coker et al.
6,775,174 B2 8/2004 Huffman et al.
6,778,155 B2 8/2004 Doherty et al.
6,781,643 B1 8/2004 Watanabe et al.
6,787,384 B2 9/2004 Okumura
6,787,438 B1 9/2004 Nelson
6,788,520 B1 9/2004 Behin et al.
6,794,119 B2 9/2004 Miles
6,811,267 B1 11/2004 Allen et al.
6,813,060 B1 11/2004 Garcia et al.
6,819,469 B1 11/2004 Koba
6,822,628 B2 11/2004 Dunphy et al.
6,825,835 B2 11/2004 Sano et al.
6,829,132 B2 12/2004 Martin et al.
6,853,129 B1 2/2005 Cummings et al.
6,855,610 B2 2/2005 Tung et al.
6,859,218 B1 2/2005 Luman et al.
6,861,277 B1 3/2005 Monroe et al.
6,862,022 B2 3/2005 Slupe
6,862,029 B1 3/2005 D'Souza et al.
6,867,896 B2 3/2005 Miles
6,870,581 B2 3/2005 Li et al.
6,903,860 B2 6/2005 Ishii
7,006,071 B2 * 2/2006 Bu ..... 345/100
7,123,216 B1 10/2006 Miles
7,161,728 B2 1/2007 Sampsell et al.
7,187,423 B2 * 3/2007 Ozaki et al. ..... 349/54
7,196,837 B2 * 3/2007 Sampsell et al. ..... 359/290
7,369,124 B2 * 5/2008 Nakano et al. ..... 345/204
2001/0003487 A1 6/2001 Miles
2001/0034075 A1 10/2001 Onoya
2001/0043171 A1 11/2001 Van Gorkom et al.
2001/0046081 A1 11/2001 Hayashi et al.
2001/0051014 A1 12/2001 Behin et al.
2002/0000959 A1 1/2002 Colgan et al.
2002/0005827 A1 1/2002 Kobayashi
2002/0012159 A1 1/2002 Tew
2002/0015215 A1 2/2002 Miles
2002/0024711 A1 2/2002 Miles
2002/0036304 A1 3/2002 Ehmke et al.
2002/0050882 A1 5/2002 Hyman et al.
2002/0054424 A1 5/2002 Miles et al.
2002/0075226 A1 6/2002 Lippincott
2002/0075555 A1 6/2002 Miles
2002/0093722 A1 7/2002 Chan et al.
2002/0097133 A1 7/2002 Charvet et al.
2002/0126364 A1 9/2002 Miles
2002/0179421 A1 12/2002 Williams et al.
2002/0186108 A1 12/2002 Hallbjorner
2003/0004272 A1 1/2003 Power
2003/0043157 A1 3/2003 Miles
2003/0072070 A1 4/2003 Miles
2003/0112230 A1 6/2003 Maeda et al.
2003/0122773 A1 7/2003 Washio et al.
2003/0137215 A1 7/2003 Cabuz
2003/0137521 A1 7/2003 Zehner et al.
2003/0189536 A1 10/2003 Ruigt
2003/0202264 A1 10/2003 Weber et al.
2003/0202265 A1 10/2003 Reboa et al.
2003/0202266 A1 10/2003 Ring et al.
2004/0008396 A1 1/2004 Stappaerts
2004/0022044 A1 2/2004 Yasuoka et al.
2004/0026757 A1 2/2004 Crane et al.
2004/0027701 A1 2/2004 Ishikawa
2004/0051929 A1 3/2004 Sampsell et al.
2004/0058532 A1 3/2004 Miles et al.
2004/0080807 A1 4/2004 Chen et al.
2004/0145049 A1 7/2004 McKinnell et al.
2004/0147056 A1 7/2004 McKinnell et al.
2004/0160143 A1 8/2004 Shreeve et al.
2004/0174583 A1 9/2004 Chen et al.
2004/0179281 A1 9/2004 Reboa
2004/0212026 A1 10/2004 Van Brocklin et al.
2004/0217378 A1 11/2004 Martin et al.
2004/0217919 A1 11/2004 Pichl et al.
2004/0218251 A1 11/2004 Piehl et al.
2004/0218334 A1 11/2004 Martin et al.
2004/0218341 A1 11/2004 Martin et al.
2004/0223204 A1 11/2004 Mao et al.
2004/0227493 A1 11/2004 Van Brocklin et al.
2004/0240032 A1 12/2004 Miles
2004/0240138 A1 12/2004 Martin et al.
2004/0245588 A1 12/2004 Nikkel et al.
2004/0263944 A1 12/2004 Miles et al.
2005/0001828 A1 1/2005 Martin et al.
2005/0012577 A1 1/2005 Pillans et al.
2005/0038950 A1 2/2005 Adelmann
2005/0057442 A1 3/2005 Way
2005/0068583 A1 3/2005 Gutkowski et al.
2005/0069209 A1 3/2005 Damera-Venkata et al.
2005/0116924 A1 6/2005 Sauvante et al.
2005/0168431 A1 8/2005 Chui
2005/0206991 A1 9/2005 Chui et al.
2005/0286113 A1 12/2005 Miles
2005/0286114 A1 12/2005 Miles

| | | | |
|---|---|---|---|
| 2006/0044246 | A1 | 3/2006 | Mignard |
| 2006/0044298 | A1 | 3/2006 | Mignard et al. |
| 2006/0044928 | A1 | 3/2006 | Chui et al. |
| 2006/0056000 | A1 | 3/2006 | Mignard |
| 2006/0057754 | A1 | 3/2006 | Cummings |
| 2006/0066542 | A1 | 3/2006 | Chui |
| 2006/0066553 | A1 | 3/2006 | Deane |
| 2006/0066559 | A1 | 3/2006 | Chui et al. |
| 2006/0066560 | A1 | 3/2006 | Gally et al. |
| 2006/0066561 | A1 | 3/2006 | Chui et al. |
| 2006/0066594 | A1 | 3/2006 | Tyger |
| 2006/0066597 | A1 | 3/2006 | Sampsell |
| 2006/0066601 | A1 | 3/2006 | Kothari et al. |
| 2006/0066937 | A1 | 3/2006 | Chui |
| 2006/0066938 | A1 | 3/2006 | Chui |
| 2006/0067648 | A1 | 3/2006 | Chui et al. |
| 2006/0067653 | A1 | 3/2006 | Gally et al. |
| 2006/0077127 | A1 | 4/2006 | Sampsell et al. |
| 2006/0077505 | A1 | 4/2006 | Chui et al. |
| 2006/0077520 | A1 | 4/2006 | Chui et al. |
| 2006/0103613 | A1 | 5/2006 | Chui |

FOREIGN PATENT DOCUMENTS

| | | | |
|---|---|---|---|
| EP | 0300754 | A2 | 1/1989 |
| EP | 0306308 | A2 | 3/1989 |
| EP | 0318050 | A | 5/1989 |
| EP | 0 417 523 | A | 3/1991 |
| EP | 0 467 048 | A | 1/1992 |
| EP | 0570906 | A | 11/1993 |
| EP | 0608056 | A1 | 7/1994 |
| EP | 0655725 | A1 | 5/1995 |
| EP | 0 667 548 | A1 | 8/1995 |
| EP | 0725380 | A1 | 8/1996 |
| EP | 0852371 | A1 | 7/1998 |
| EP | 0911794 | A1 | 4/1999 |
| EP | 1 017 038 | A | 7/2000 |
| EP | 1 146 533 | A | 10/2001 |
| EP | 1343190 | A | 9/2003 |
| EP | 1345197 | A | 9/2003 |
| EP | 1381023 | A | 1/2004 |
| EP | 1473691 | A2 | 11/2004 |
| GB | 2401200 | A | 11/2004 |
| JP | 2002 175053 | | 6/2002 |
| JP | 2004-29571 | | 1/2004 |
| JP | 2004 004553 | | 8/2004 |
| WO | WO 95/30924 | | 11/1995 |
| WO | WO 97/17628 | | 5/1997 |
| WO | WO 99/52006 | A3 | 10/1999 |
| WO | WO 01/73937 | A | 10/2001 |
| WO | WO 03/007049 | A1 | 1/2003 |
| WO | WO 03/015071 | A2 | 2/2003 |
| WO | WO 03/044765 | A2 | 5/2003 |
| WO | WO 03/060940 | A | 7/2003 |
| WO | WO 03/069413 | A1 | 8/2003 |
| WO | WO 03/073151 | A1 | 9/2003 |
| WO | WO 03/079323 | A | 9/2003 |
| WO | WO 03/090199 | A1 | 10/2003 |
| WO | WO 2004/006003 | A1 | 1/2004 |
| WO | WO 2004/026757 | A2 | 4/2004 |
| WO | WO 2004/049034 | A1 | 6/2004 |

OTHER PUBLICATIONS

Miles, MEMS-based interferometric modulator for display applications, Part of the SPIE Conference on Micromachined Devices and Components, vol. 3876, pp. 20-28 (1999).

Miles et al., 5.3: Digital Paper™: Reflective displays using interferometric modulation, SID Digest, vol. XXXI, 2000 pp. 32-35.

Extended European Search Report for App. No. 05255698.2 dated Nov. 22, 2007.

Peroulis et al., Low contact resistance series MEMS switches, 2002, pp. 223-226, vol. 1, IEEE MTT-S International Microwave Symposium Digest, New York, NY.

Office Action in Chinese App. No. 200510105834.X, received May 29, 2008.

Office Action in Chinese App. No. 200510105834.X, received Jun. 6, 2009.

Decision of Rejection in Chinese App. No. 200510105834.X, received Jan. 10, 2010.

Bains, "Digital Paper Display Technology holds Promise for Portables", CommsDesign EE Times (2000).

Lieberman, "MEMS Display Looks to give PDAs Sharper Image" EE Times (2004).

Lieberman, "Microbridges at heart of new MEMS displays" EE Times (2004).

* cited by examiner

| | | Column Output Signals | |
|---|---|---|---|
| | | $+V_{bias}$ | $-V_{bias}$ |
| Row Output Signals | 0 | Stable | Stable |
| | $+\Delta V$ | Release | Actuate |
| | $-\Delta V$ | Actuate | Release |

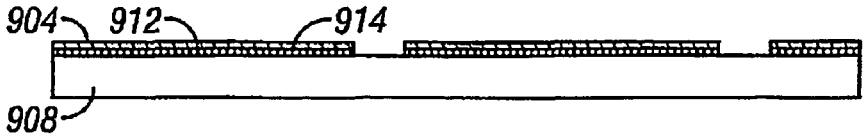
FIG. 9A
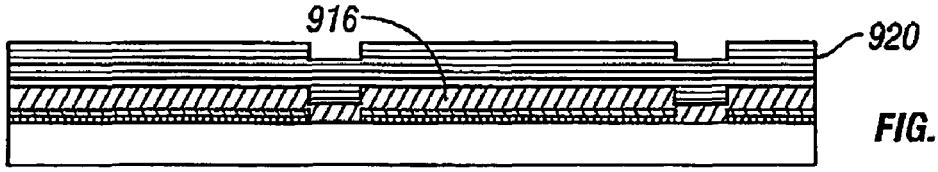
FIG. 9B
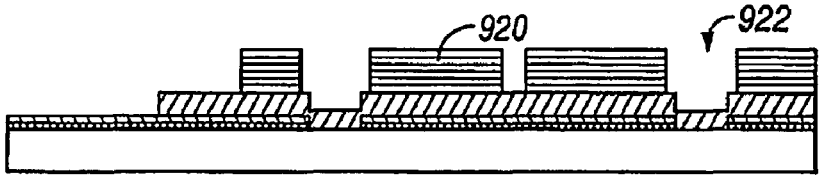
FIG. 9C
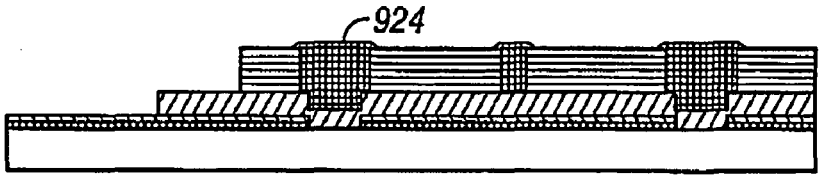
FIG. 9D
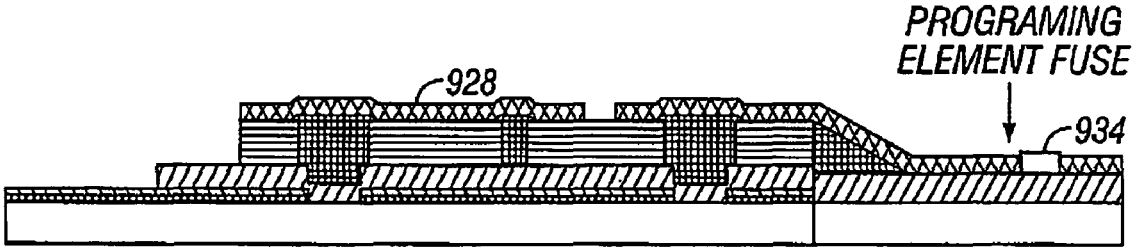
FIG. 9E
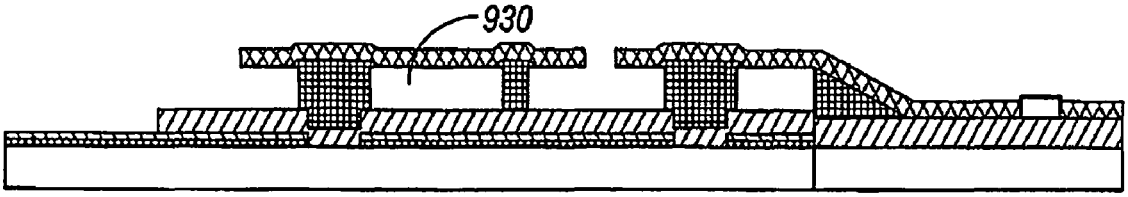
FIG. 9F
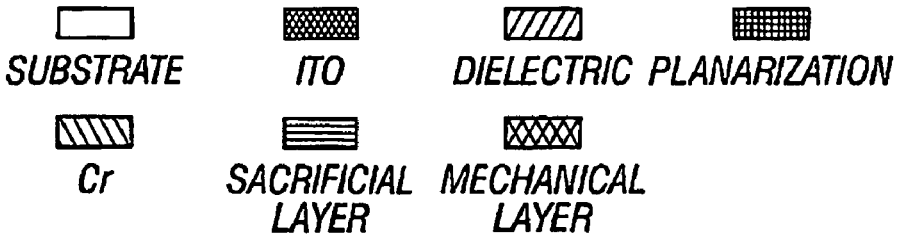

METHOD AND DEVICE FOR ELECTRICALLY PROGRAMMABLE DISPLAY

CROSS-REFERENCE TO RELATED APPLICATIONS

This application claims the benefit under 35 U.S.C. §119 (e) of U.S. Provisional Application No. 60/613,379, filed Sep. 27, 2004, the entirety of which is hereby incorporated by reference herein.

BACKGROUND

1. Field of the Invention

The invention generally relates to microelectromechanical systems (MEMS).

2. Description of the Related Art

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. These MEMS devices can be used in a variety of applications, such as in optical applications and in electrical circuit applications.

One type of MEMS device is called an interferometric modulator. An interferometric modulator may comprise a pair of conductive plates, one or both of which may be transparent and/or reflective in whole or part and capable of relative motion upon application of an appropriate electrical signal. One plate may comprise a stationary layer deposited on a substrate, the other plate may comprise a metallic membrane separated from the stationary layer by an air gap. Such devices have a wide range of applications, and it would be beneficial in the art to utilize and/or modify the characteristics of these types of devices so that their features can be exploited in improving existing products and creating new products that have not yet been developed.

Another type of MEMS device is used as a multiple-state capacitor. For example, the capacitor can comprise a pair of conductive plates with at least one plate capable of relative motion upon application of an appropriate electrical control signal. The relative motion changes the capacitance of the capacitor, permitting the capacitor to be used in a variety of applications, such as a filtering circuit, tuning circuit, phase-shifting circuit, an attenuator circuit, and the like.

SUMMARY

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

One embodiment comprises a display. The display may comprise an array having a plurality of rows and columns of interferometric modulators. The display may also comprise a plurality of electrical conductors. Each of the electrical conductors is connected to one of the plurality rows or columns. At least two of the conductors are configured to be selectively electrically interconnected thereby modifying a resolution characteristic of at least a region of the display.

Yet another embodiment comprises a display. The display comprises a plurality of rows and columns of interferometric modulators. The display also comprises a plurality of electrical conductors. Each of the electrical conductors are connected to one of the plurality rows or columns. At least two of the conductors are electrically connected together. At least two of the conductors are configured to be selectively electrically disconnected thereby modifying a resolution characteristic of at least a region of the display.

Yet another embodiment comprises a method. The method comprises electrically connecting, via a switch, at least two adjacent columns of a display to each other and at least two adjacent rows of the display to each other so as to modify a resolution characteristic of the display.

BRIEF DESCRIPTION OF THE DRAWINGS

These drawings (not to scale) and the associated description herein are provided to illustrate embodiments and are not intended to be limiting.

FIGS. 9A-9F are cross sectional elevational views of a plurality of layers that deposited during the fabrication of the interferometric modulator of FIG. 6A

DETAILED DESCRIPTION OF CERTAIN EMBODIMENTS

The following detailed description is directed to certain specific embodiments of the invention. However, the invention can be embodied in a multitude of different ways. In this description, reference is made to the drawings wherein like parts are designated with like numerals throughout. As will be apparent from the following description, the invention may be implemented in any device that is configured to display an image, whether in motion (e.g., video) or stationary (e.g., still image), and whether textual or pictorial. More particularly, it is contemplated that the invention may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

The amount of resolution required of a display varies greatly from application to application. By providing a display that has sufficient resolution to cover all applications, the cost of the display can be reduced through economies of scale. However, this high resolution can result in unnecessary driver costs to the user with low resolution needs. One embodiment provides an array of modulators, where the leads to the modulators are selectively coupled in order to actuate groups of sub-pixel elements. This reduces the lead count at the expense of unnecessary display resolution.

Figure 1:
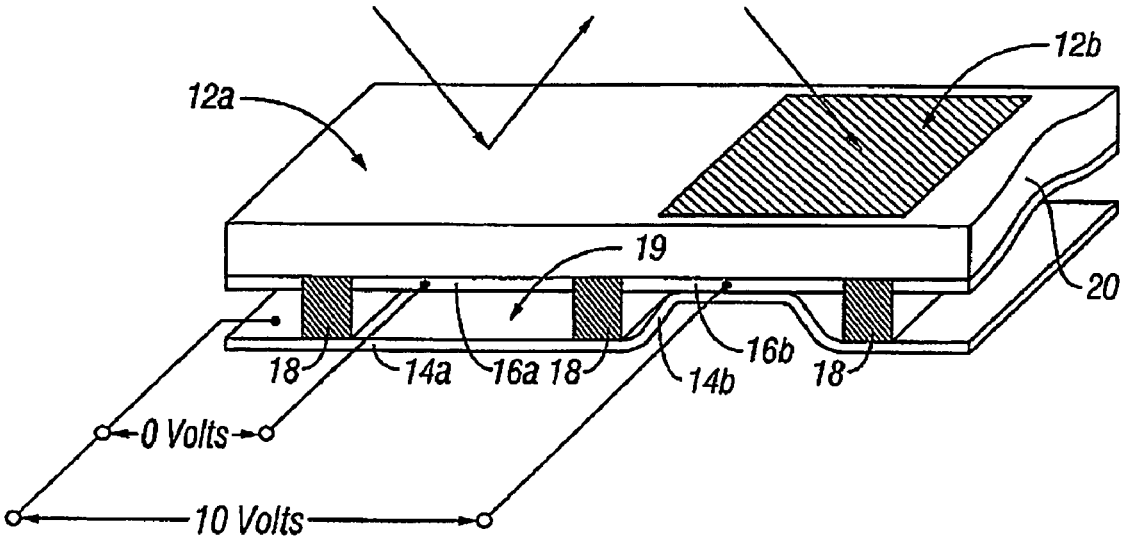
FIG. 1 is an isometric view depicting a portion of one embodiment of an interferometric modulator display in which a movable reflective layer of a first interferometric modulator is in a released position and a movable reflective layer of a second interferometric modulator is in an actuated position.

One interferometric modulator display embodiment comprising an interferometric MEMS display element is illustrated in FIG. 1. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the relaxed, the movable layer is positioned at a relatively large distance from a fixed partially reflective layer. In the second position, the movable layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable and highly reflective layer 14*a* is illustrated in a relaxed position at a predetermined distance from a fixed partially reflective layer 16*a*. In the interferometric modulator 12*b* on the right, the movable highly reflective layer 14*b* is illustrated in an actuated position adjacent to the fixed partially reflective layer 16*b*.

The fixed layers 16*a*, 16*b* are electrical conductors which electrically conductive, partially transparent and partially reflective, and may be fabricated, for example, by depositing one or more layers each of chromium and indium-tin-oxide onto a transparent substrate 20. The layers are patterned into parallel strips, and may form row electrodes in a display device as described further below. The movable layers 14*a*, 14*b* may be formed as a series of parallel strips of a deposited metal layer or layers (orthogonal to the row electrodes 16*a*, 16*b*) deposited on top of posts 18 and an intervening sacrificial material deposited between the posts 18. When the sacrificial material is etched away, the deformable metal layers 14*a*, 14*b* are separated from the fixed metal layers by a defined gap 19. A highly conductive and reflective material such as aluminum may be used for the deformable layers, and these strips may form column electrodes in a display device.

With no applied voltage, the cavity 19 remains between the layers 14*a*, 16*a* and the deformable layer is in a mechanically relaxed state as illustrated by the pixel 12*a* in FIG. 1. However, when a potential difference is applied to a selected row and column, the capacitor formed at the intersection of the row and column electrodes at the corresponding pixel becomes charged, and electrostatic forces pull the electrodes together. If the voltage is high enough, the movable layer is deformed and is forced against the fixed layer (a dielectric material which is not illustrated in this Figure may be deposited on the fixed layer to prevent shorting and control the separation distance) as illustrated by the pixel 12*b* on the right in FIG. 1. The behavior is the same regardless of the polarity of the applied potential difference. In this way, row/column actuation that can control the reflective vs. non-reflective pixel states is analogous in many ways to that used in conventional LCD and other display technologies.

FIGS. 2 through 5 illustrate one exemplary process and system for using an array of interferometric modulators in a display application.

Figure 2:
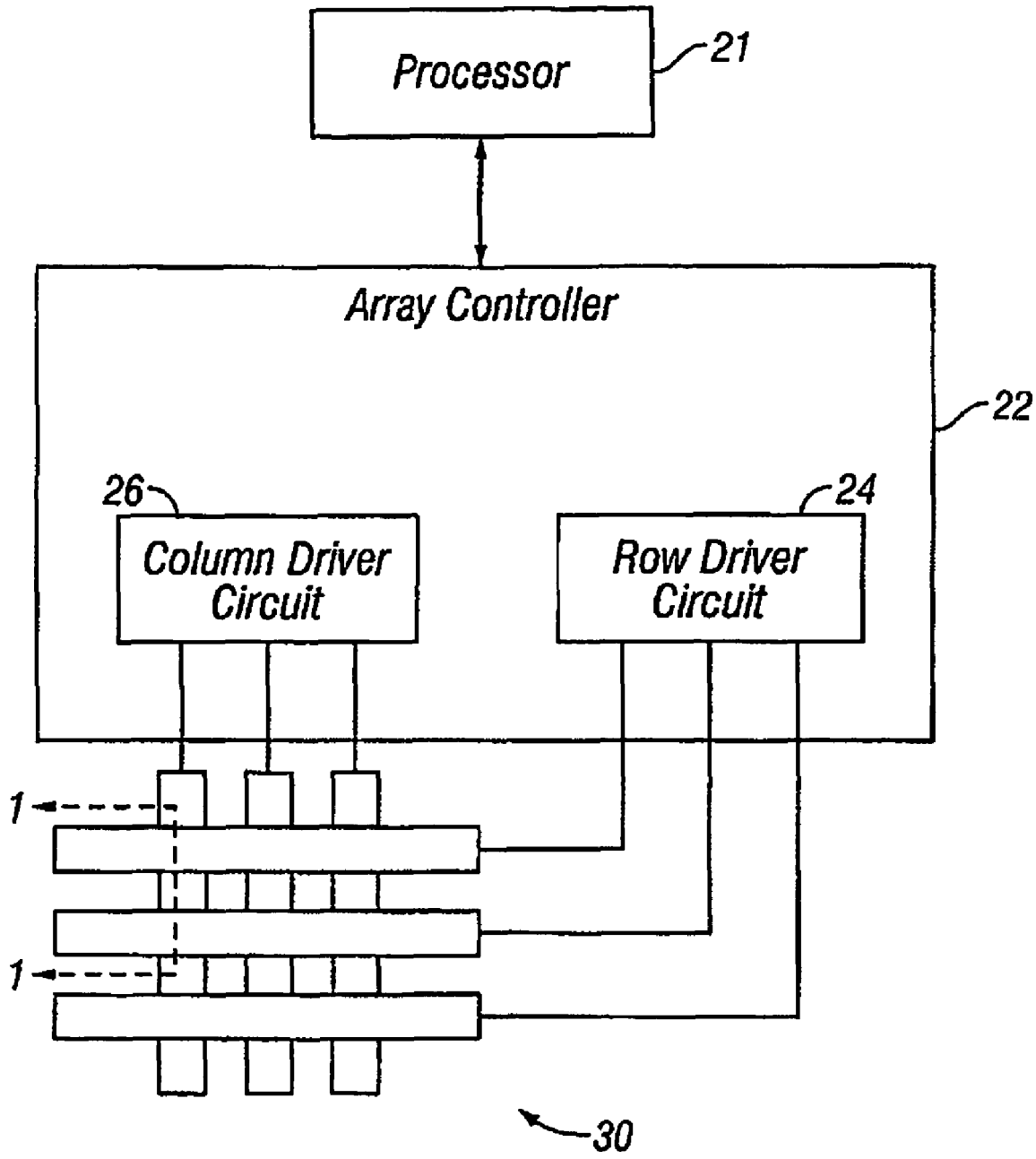
FIG. 2 is a system block diagram illustrating one embodiment of an electronic device incorporating a 3×3 interferometric modulator display.

FIG. 2 is a system block diagram illustrating one embodiment of an electronic device that may incorporate aspects of the invention. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array controller 22. In one embodiment, the array controller 22 includes a row driver circuit 24 and a column driver circuit 26 that provide signals to a display array or panel 30. The cross section of the array illustrated in FIG. 1 is shown by the lines 1-1 in FIG. 2. For MEMS interferometric modulators, the row/column actuation protocol may take advantage of a hysteresis property of these devices illustrated in FIG. 3. It may require, for example, a 10 volt potential difference to cause a movable layer to deform from the relaxed state to the actuated state. However, when the voltage is reduced from that value, the movable layer maintains its state as the voltage drops back below 10 volts. In the exemplary embodiment of FIG. 3, the movable layer does not relax completely until the voltage drops below 2 volts. There is thus a range of voltage, about 3 to 7 V in the example illustrated in FIG. 3, where there exists a window of applied voltage within which the device is stable in either the relaxed or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new display data by continually repeating this process at some desired number of frames per second. A wide variety of protocols for driving row and column electrodes of pixel arrays to produce display frames are also well known and may be used in conjunction with the present invention.

Figures 3, 4:
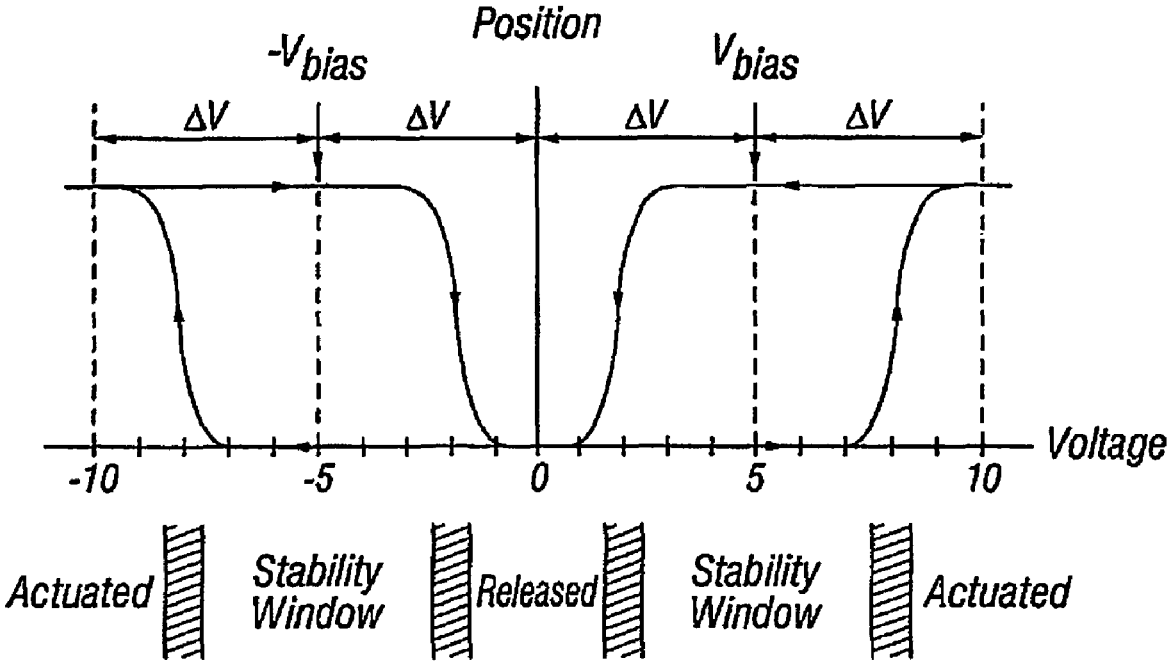
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.

FIGS. 4 and 5 illustrate one possible actuation protocol for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts respectively Relaxing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. As is also illustrated in FIG. 4, it will be appreciated that voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

Figure 5A:
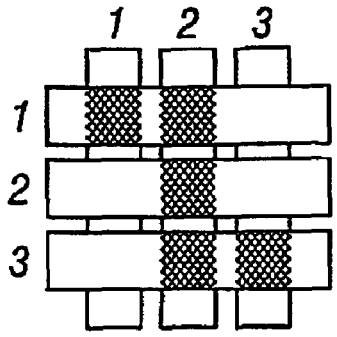
FIGS. 5A and 5B illustrate one exemplary timing diagram for row and column signals that may be used to write a frame of display data to the 3×3 interferometric modulator display of FIG. 2.
Figure 5B:
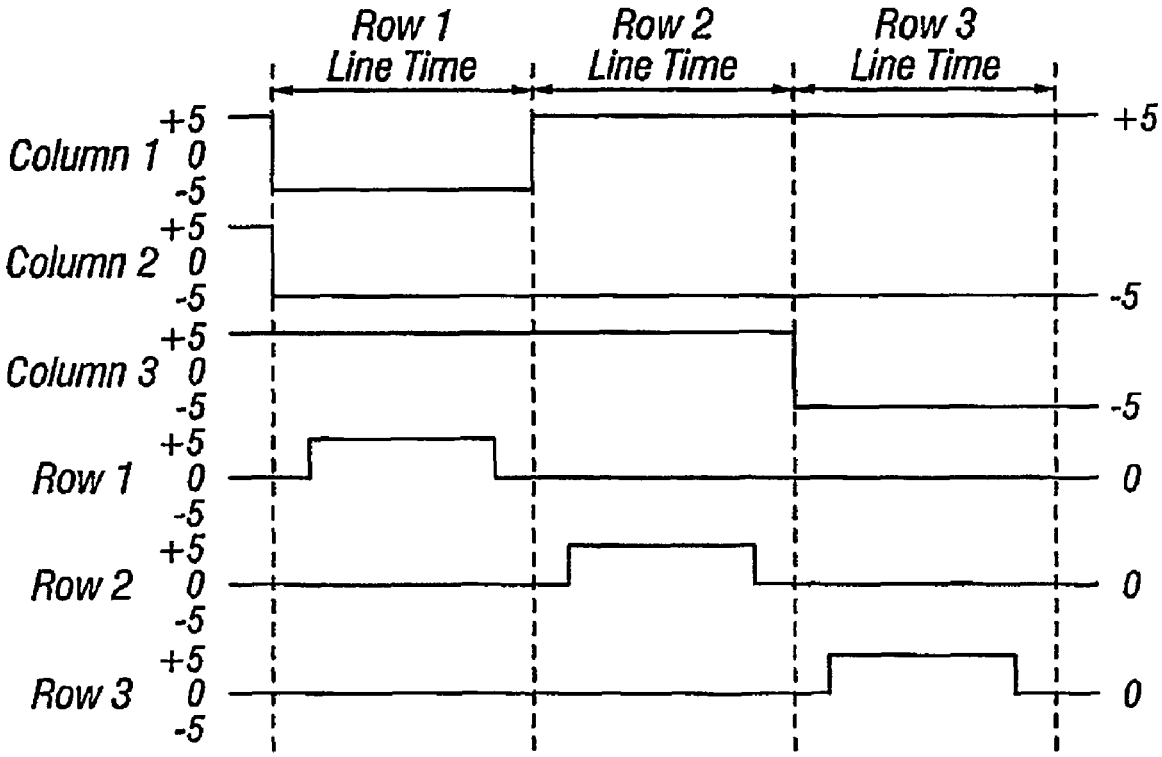

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or relaxed states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and relaxes the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and relax pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used with the systems and methods described herein.

Figure 11A:
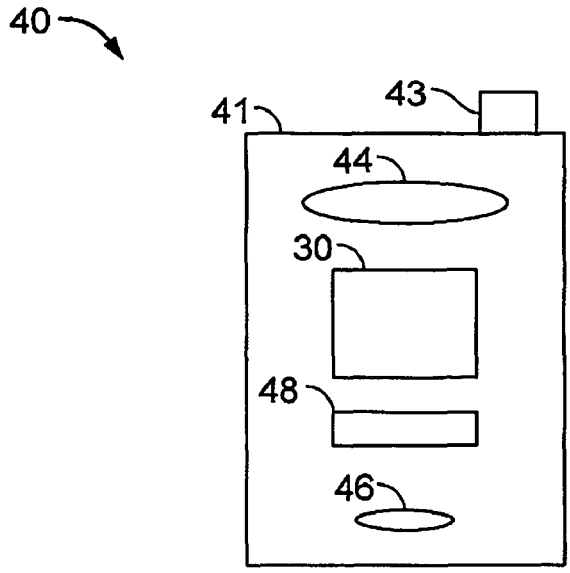
FIGS. 11A and 11B are system block diagrams illustrating an exemplary embodiment of a display device.
Figure 11B:
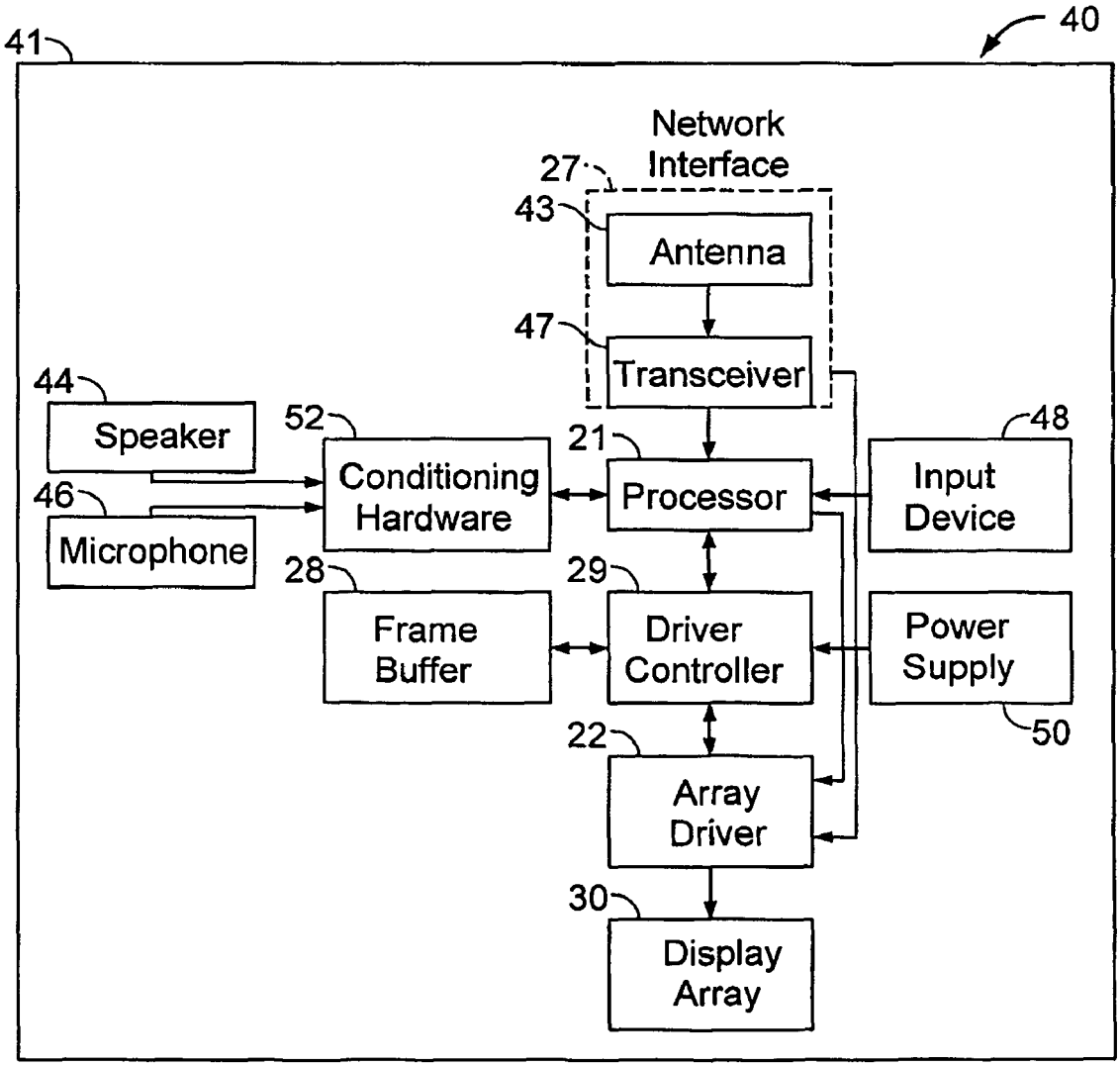

FIGS. 11A and 11B are system block diagrams illustrating an embodiment of a display device 40. The display device 40 can be, for example, a cellular or mobile telephone. However, the same components of display device 40 or slight variations thereof are also illustrative of various types of display devices such as televisions and portable media players.

The display device 40 includes a housing 41, a display 30, an antenna 43, a speaker 44, an input device 48, and a microphone 46. The housing 41 is generally formed from any of a variety of manufacturing processes as are well known to those of skill in the art, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 30 includes an interferometric modulator display, as described herein.

The components of one embodiment of exemplary display device 40 are schematically illustrated in FIG. 11B. The illustrated exemplary display device 40 includes a housing 41 and can include additional components at least partially enclosed therein. For example, in one embodiment, the exemplary display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g. filter a signal). The conditioning hardware 52 is connected to a speaker 44 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one ore more devices over a network. In one embodiment the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the exemplary display device 40. Conditioning hardware 52 generally includes amplifiers and filters for transmitting signals to the speaker 44, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators).

The input device 48 allows a user to control the operation of the exemplary display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In some implementations control programmability resides, as described above, in a driver controller which can be located in several places in the electronic display system. In some cases control programmability resides in the array driver 22. Those of skill in the art will recognize that the above-described optimization may be implemented in any number of hardware and/or software components and in various configurations.

Figure 6A:
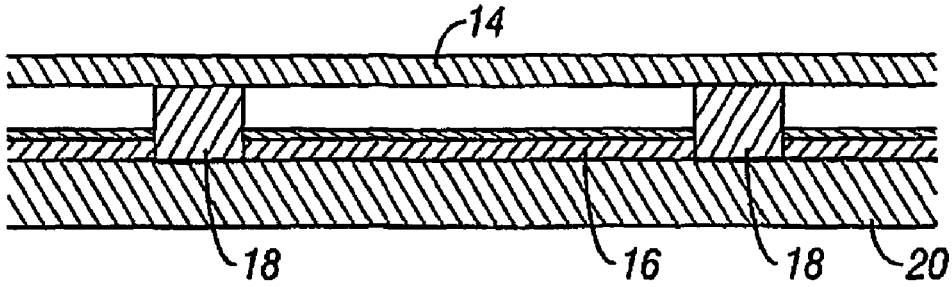
FIG. 6A is a cross section of the device of FIG. 1.
Figure 6B:
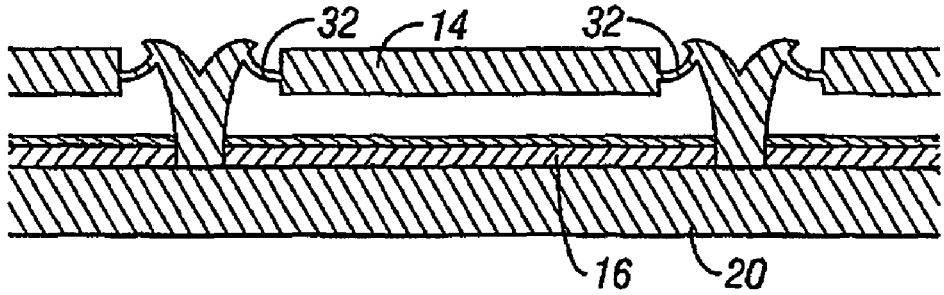
FIG. 6B is a cross section of an alternative embodiment of an interferometric modulator.
Figure 6C:
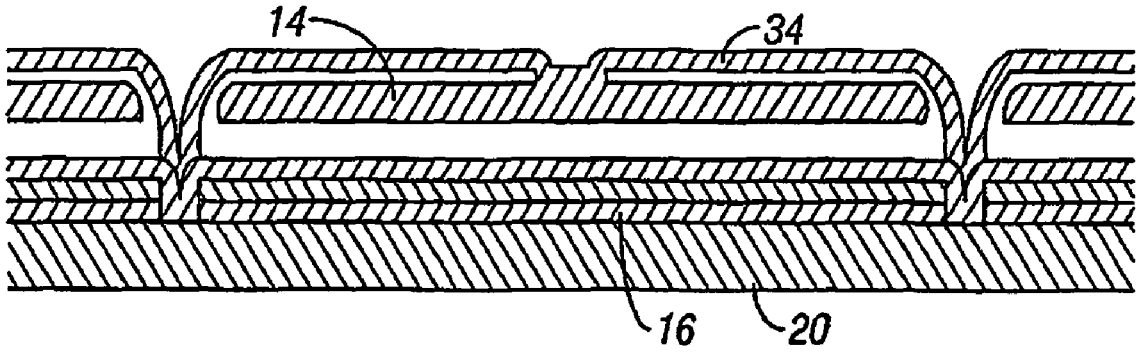
FIG. 6C is a cross section of another alternative embodiment of an interferometric modulator.

The details of the structure of interferometric modulators that operate in accordance with the principles set forth above may vary widely. For example, FIGS. 6A-6C illustrate three different embodiments of the moving mirror structure. FIG. 6A is a cross section of the embodiment of FIG. 1, where a strip of metal material 14 is deposited on orthogonally extending supports 18. In FIG. 6B, the moveable reflective material 14 is attached to supports at the corners only, on tethers 32. In FIG. 6C, the moveable reflective material 14 is suspended from a deformable layer 34. This embodiment has benefits because the structural design and materials used for the reflective material 14 can be optimized with respect to the optical properties, and the structural design and materials used for the deformable layer 34 can be optimized with respect to desired mechanical properties. The production of various types of interferometric devices is described in a variety of published documents, including, for example, U.S. Published Application 2004/0051929. A wide variety of known techniques may be used to produce the above described structures involving a series of material deposition, patterning, and etching steps.

The amount of resolution required of a display varies greatly from application to application. By providing a display that has sufficient resolution to cover all applications, the cost of the display can be reduced through economies of scale. However, this high resolution can result in unnecessary driver costs to the user with low resolution needs. One embodiment provides an array of modulators, where the leads to the modulators are selectively coupled in order to actuate groups of sub-pixel elements. This reduces the lead count at the expense of unnecessary display resolution.

Figure 7:
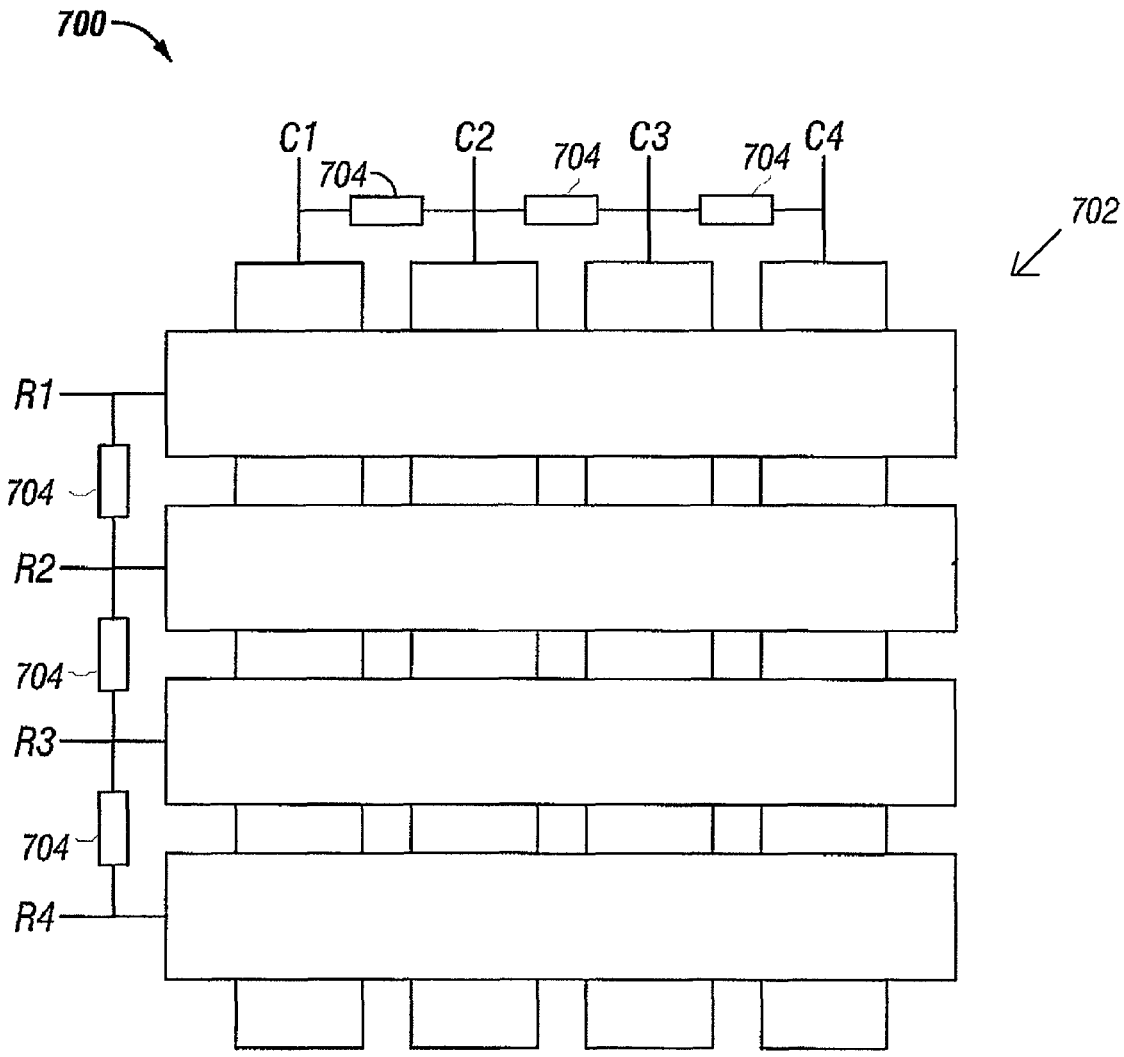
FIG. 7 is a block diagram of an exemplary display.

FIG. 7 illustrates an exemplary embodiment of a display 700. The display 700 includes an array of interferometric modulators 702. The modulators can include any of the interferometric modulators shown in FIGS. 6A, 6B, 6C, or can be of other manufacture. M row electrical conductors (R1-R4) are provided to select the row of modulators to be written to and N column electrical conductors (C1-C4) are provided to write to the modulators. 502 on the selected column. It is to be appreciated that the display can be manufactured include any number of rows or columns.

In one embodiment, adjacent row and column leads are electrically connectable via switches 704. The switches can include a fuse, antifuse, jumper pins, transistor, or other type of switching device. An example of an antifuse is described in "A Comparative Study of the On-Off Switching Behavior of Metal-Insulator-Metal Antifuses", IEEE ELECTRON DEVICE LETTERS, Vol. 21, No. 6, June 2000, by Li, et al. In one embodiment, the switches are in "closed" state and can be placed in a "open" state by application of an electrical signal, such as a large current. For example, if the switch comprises a fuse, the large current shorts the fuse causing an open circuit. In another embodiment, the switches are in an "open" state and can be placed in a "closed" state by application of an electrical signal, such as a large current. For example, if the switches 704 comprise an antifuse, the electrical signal causes the switch to go from an "open" to a "closed" position. Furthermore, in one embodiment, the operation of the switches 704 can be programmatically controlled. In this embodiment, each of the switches 704 can be connected to a control circuit for operable control thereof.

By modifying the state of the switches, a resolution characteristic of the display can be configured. A single manufacturing process may be employed to create displays offering different resolution characteristics. The state, i.e., open or closed, of the switch can be selected subsequent to manufacture and prior to sale to a vendor or a customer. In one embodiment, if the switches are programmatically controllable, the resolution characteristic of the display can be modified by a controller of the display.

For exemplary purpose, two customers may both purchase display illustrated in FIG. 7. However, a first customer may require the full resolution of the display, for example 600 dpi, for his application while the second customer only wants a quarter of the available resolution, in the present example of 150 dpi, for his application. In this case the first customer may buy the display where all the switches 704 are open circuited. The second customer may be provided a display where half of the switches 704 are "closed", e.g., each pair of adjacent columns or rows are electrically tied together, and the other half are "open" which provides one quarter the number of addressable pixel elements where each pixel element is four times the size of the pixels elements in the maximum resolution display. Any combination of switches using any array size can be supported in a likewise fashion. Moreover, the pixel sizes need not be uniform in size or shape throughout the array.

Figure 8:
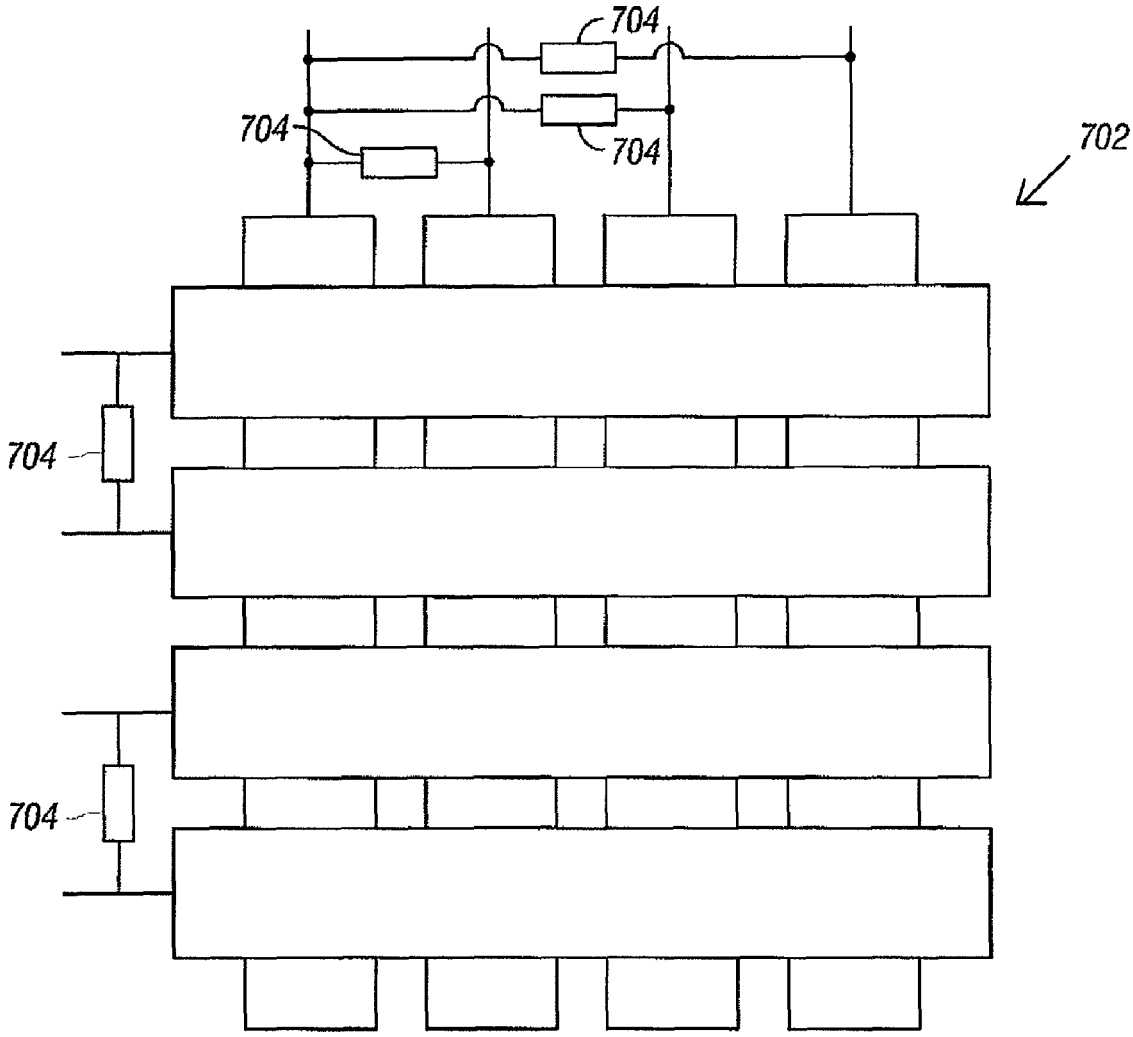
FIG. 8 is a block diagram of another exemplary display.

In one embodiment, the switches connect non-adjacent columns or rows. For example, as is shown in FIG. 8, certain switches 704 connect rows or columns, that may be 1, 2, 3, . . . , N rows or columns apart from each other. Depending on the embodiment, a selected row or column may be connected to one or more (including all) of the other rows or columns in the display. Furthermore, in one embodiment, certain rows or columns are not connected via one of the switches 704 to other columns or rows. For example, with reference to FIG. 8, it can be seen from visual inspection that the top two rows are not connected the switches to the bottom two rows.

FIGS. 9A-9F illustrate aspects of a process flow for fabricating a fuse during a fabrication process of interferometric modulators in a display. The example described below is only for the ease of understanding the embodiments described herein. Any MEMS structure that uses an air gap and electrostatic attraction could use the methods and structures described herein. In addition, any MEMS structure having a moveable element separated from its activation layer by a dielectric material, having a moving element and a moving activation layer/element, or having a moving element that touches a dielectric layer/element could use the methods and structures described herein.

In FIG. 9A, a layer 904 is formed on a transparent substrate 908. In one embodiment, the layer 904 may be a metal layer. In one embodiment, the layer 904 may include a Cr layer 912 and an ITO layer 914. Referring now to FIG. 9B, a dielectric stack 916 is then deposited on the layer 904 and then etched. FIG. 9B shows that, after the dielectric stack 916 is deposited, a sacrificial layer 920 is deposited on the dielectric stack and then etched to form holes 922 as shown in FIG. 9C. FIG. 9D shows a planarization layer 924 that has been deposited in the holes 922 of the sacrificial layer. As is shown in FIG. 9E, a mechanical layer 928 is then formed over the sacrificial layer 920 and planarization layer 924. In one embodiment, the mechanical layer 928 may have a reflective surface. In one embodiment, a fuse (switch) 934 is also patterned using the mechanical layer 928. The fuse 934 connects selected rows and or columns in the display. It is noted that the layers under the fuse 934 may include any suitable material, e.g., one or more layers may be fabricated using the deposition materials described above or otherwise. As can be seen in FIG. 9F, a selective etchant is used to remove the sacrificial layer 920, creating an air gap 930 beneath the mechanical layer 928 and over the dielectric stack 916.

Figure 10:
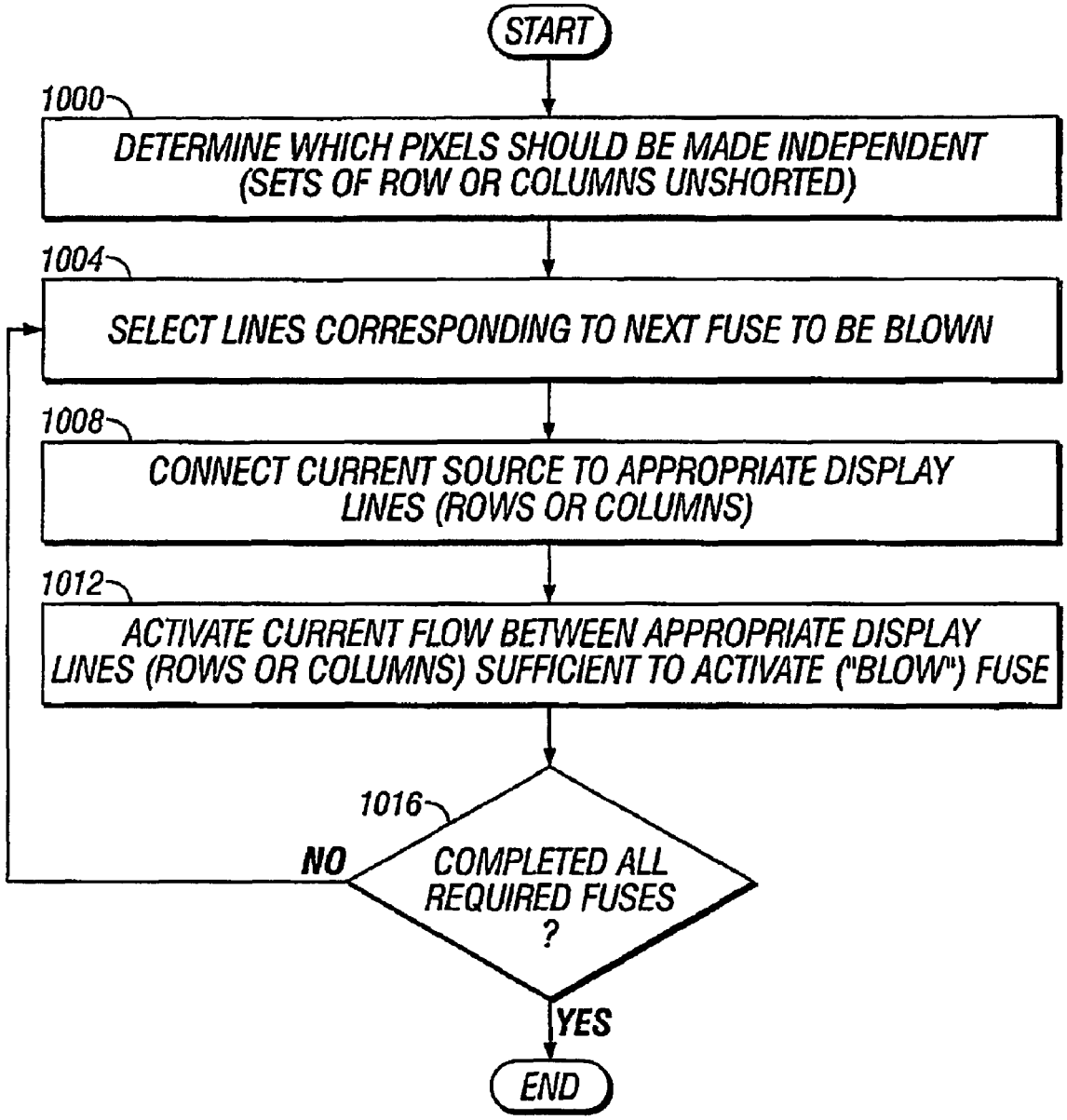
FIG. 10 is a flowchart illustrating an exemplary process of configuring a display.

FIG. 10 is a flowchart illustrating an exemplary process of configuring a display device to have a selected resolution characteristic. Depending on the embodiment, additional steps may be added, others removed, and the ordering of the steps rearranged. The flowchart of FIG. 10 is generally to configuring a display where the switch elements include fuses. It is to be appreciated that the process flow could be adapted for use wherein the switches comprise antifuses, transistors or otherwise.

Starting at a step 1000, it is determined which pixels of the display should be made independent, i.e., determine which fuses should remain unshorted. Continuing to a step 1004, the fuse that is to be blown, i.e., put in an "open" state, is identified. Next, at a step 1008, a current source is connected to the appropriate lines in the display. Moving to a step 1012, the current source is activated and the respective fuse is blown. Proceeding to a decision step 1016, it is determined whether all required fuses have been activated. If all required fuses have been not been activated, the process return to state 1004. However, if all required fuses have been activated, the process ends.

Various embodiments have been described above. Although described with reference to these specific embodiments, the descriptions are intended to be illustrative and are not intended to be limiting. Various modifications and applications may occur to those skilled in the art without departing from the true spirit and scope of the invention as defined in the appended claims.

What is claimed is:

1. An apparatus having a display, the apparatus comprising:

an array comprising a plurality of rows and columns of interferometric modulators; and a plurality of electrical conductors, each of the electrical conductors connecting to one of the plurality rows or columns, at least two of the conductors being configured to be selectively electrically interconnected by a switch mean thereby modifying a resolution characteristic of at least a region of the display by altering the number of interferometric modulators that are individually addressable, wherein the at least two conductors are connected respectively to rows or columns that are physically non-adjacent with respect to each other.

2. The apparatus of claim 1, wherein the at least two conductors are connected via, at least in part, an antifuse.

3. The apparatus of claim 2, wherein the antifuse is fabricated during a fabrication process of the array of interferometric modulators.

4. The apparatus of claim 1, wherein the at least two conductors are connected via, at least in part, a transistor.

5. The apparatus of claim 1, further comprising:

a processor that is in electrical communication with said display, said processor being configured to process image data;

a memory device in electrical communication with said processor.

6. The display system as recited in claim 5, further comprising:

a first controller configured to send at least one signal to said display; and a second controller configured to send at least a portion of said image data to said first controller.

7. The display system as recited in claim 5, further comprising:

an image source module configured to send said image data to said processor.

8. The display system as recited in claim 7, wherein said image source module comprises at least one of a receiver, transceiver, and transmitter.

9. The display system as recited in claim 5, further comprising:

an input device configured to receive input data and to communicate said input data to said processor.

10. A display, comprising:

an array comprising a plurality of rows and columns of interferometric modulators; and a plurality of electrical conductors, each of the electrical conductors connecting to one of the plurality rows or columns, at least two of the conductors being electrically connected together, at least two of the conductors being configured connected together by a switch mean, at least two of the conductors being configured to be selectively electrically disconnected by said switch mean thereby modifying a resolution characteristic of at least a region of the display by altering the number of interferometric modulators that are individually addressable, wherein the at least two conductors are connected respectively to rows or columns that are physically non-adjacent with respect to each other.

11. The display of claim 10, wherein the at least two conductors are connected via, at least in part, a fuse.

12. The display of claim 11, wherein the fuse is fabricated during a fabrication process of the array of interferometric modulators.

13. The display of claim 10, wherein the at least two conductors are connected via, at least in part, a transistor.

14. An apparatus having a display, the apparatus comprising:

an array comprising a plurality of rows and columns of interferometric modulators; and a plurality of electrical conductors, each of the electrical conductors connecting to one of the plurality rows or columns, at least two of the conductors being configured to be selectively electrically interconnected by a switch mean thereby modifying a resolution characteristic of at least a region of the display by altering the number of interferometric modulators that are individually addressable, wherein the at least two conductors are connected via, at least in part, an antifuse.

15. The apparatus of claim 14, wherein the antifuse is fabricated during a fabrication process of the array of interferometric modulators.

16. A display, comprising:

an array comprising a plurality of rows and columns of interferometric modulators; and a plurality of electrical conductors, each of the electrical conductors connecting to one of the plurality rows or columns, at least two of the conductors being electrically connected together, at least two of the conductors being configured connected together by a switch mean, at least two of the conductors being configured to be selectively electrically disconnected by said switch mean thereby modifying a resolution characteristic of at least a region of the display by altering the number of interferometric modulators that are individually addressable, wherein the at least two conductors are connected via, at least in part, a fuse.

17. The display of claim 16, wherein the fuse is fabricated during a fabrication process of the array of interferometric modulators.

* * * * *